US010214315B2

(12) United States Patent
Oliveira

(10) Patent No.: US 10,214,315 B2
(45) Date of Patent: Feb. 26, 2019

(54) CARTON WITH REINFORCEMENT FEATURES

(71) Applicant: Graphic Packaging International, Inc., Atlanta, GA (US)

(72) Inventor: Steven M. Oliveira, Canton, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 580 days.

(21) Appl. No.: 14/940,678

(22) Filed: Nov. 13, 2015

(65) Prior Publication Data

US 2016/0137338 A1 May 19, 2016

Related U.S. Application Data

(60) Provisional application No. 62/123,438, filed on Nov. 17, 2014.

(51) Int. Cl.
*B65D 5/06* (2006.01)
*B65D 5/468* (2006.01)
*B65D 5/66* (2006.01)

(52) U.S. Cl.
CPC ..... *B65D 5/4608* (2013.01); *B65D 5/06* (2013.01); *B65D 5/6658* (2013.01)

(58) Field of Classification Search
CPC ..... B65D 5/4608; B65D 5/06; B65D 5/6658
See application file for complete search history.

(56) References Cited

U.S. PATENT DOCUMENTS

| | | | |
|---|---|---|---|
| 499,655 | A | 6/1893 | Clark |
| 642,121 | A | 1/1900 | Hildreth |
| 1,503,161 | A | 7/1924 | Hornecker |
| 1,634,073 | A | 6/1927 | Labombarde |
| 1,656,919 | A | 1/1928 | Marsh |
| 1,762,704 | A | 6/1930 | Smith |
| 1,901,483 | A | 3/1933 | Ware, Jr. |
| 1,912,698 | A | 6/1933 | Forsman |
| 1,925,102 | A | 9/1933 | Levkoff |
| 1,951,408 | A | 3/1934 | Haven |
| 1,971,863 | A | 8/1934 | Lupton |
| 2,027,079 | A | 1/1936 | Weiss |
| 2,122,654 | A | 7/1938 | Nickerson |
| 2,141,743 | A | 12/1938 | Ethridge |
| 2,145,430 | A | 1/1939 | New |
| 2,152,079 | A | 3/1939 | Mott |

(Continued)

FOREIGN PATENT DOCUMENTS

| | | |
|---|---|---|
| DE | 2 320 190 | 11/1973 |
| DE | 36 27 019 | 2/1988 |

(Continued)

OTHER PUBLICATIONS

Supplementary European Search Report for EP 15 86 1002 dated Apr. 17, 2018.

(Continued)

*Primary Examiner* — Corey N Skurdal

(74) *Attorney, Agent, or Firm* — Womble Bond Dickinson (US) LLP

(57) ABSTRACT

A carton for holding a plurality of articles. The carton includes at least one top panel, a first side panel, a second side panel, and a bottom panel. A plurality of end flaps is foldably connected to a respective panel to close an end of the carton. The carton includes reinforcement features at the end of the carton to increase the strength of the carton.

32 Claims, 6 Drawing Sheets

(56) References Cited

U.S. PATENT DOCUMENTS

| | | | |
|---|---|---|---|
| 2,196,243 | A | 4/1940 | Bensel |
| 2,196,502 | A | 4/1940 | Kells |
| 2,222,211 | A | 11/1940 | Arneson |
| 2,290,971 | A | 7/1942 | King |
| 2,308,050 | A | 1/1943 | Burr |
| 2,330,294 | A | 9/1943 | Leavitt et al. |
| 2,383,853 | A | 8/1945 | Guyer |
| 2,386,905 | A | 10/1945 | Meitzen |
| 2,407,802 | A | 9/1946 | Stotter |
| 2,416,332 | A | 2/1947 | Lehman |
| 2,460,108 | A | 1/1949 | Smith et al. |
| 2,611,528 | A | 9/1952 | Vadner |
| 2,643,589 | A | 6/1953 | Weiss |
| 2,645,405 | A | 7/1953 | Dorfman |
| 2,648,484 | A | 8/1953 | Belsinger |
| 2,665,050 | A | 1/1954 | Baumann |
| 2,679,349 | A | 5/1954 | Mullinix |
| 2,702,155 | A | 2/1955 | Baumann |
| 2,710,134 | A | 6/1955 | Schroeder et al. |
| 2,791,362 | A | 5/1957 | Nute |
| 2,811,298 | A | 10/1957 | Jones |
| 2,875,938 | A | 3/1959 | Bramhill |
| 2,900,123 | A | 8/1959 | Drnec et al. |
| 2,933,228 | A | 4/1960 | Guyer |
| 2,954,913 | A | 10/1960 | Rossman |
| 2,955,739 | A | 10/1960 | Collura |
| 2,967,610 | A | 1/1961 | Ebert |
| 2,990,999 | A | 7/1961 | George et al. |
| 2,993,619 | A | 7/1961 | Arneson |
| 3,002,613 | A | 10/1961 | Merkel et al. |
| 3,003,676 | A | 10/1961 | De Nola |
| 3,055,569 | A | 9/1962 | Layne, Sr. |
| 3,069,065 | A | 12/1962 | Bebout et al. |
| 3,090,483 | A | 5/1963 | Altree et al. |
| 3,092,301 | A | 6/1963 | Selle |
| 3,094,266 | A | 6/1963 | Hoff |
| 3,094,268 | A | 6/1963 | Swanson et al. |
| 3,095,137 | A | 6/1963 | Reynolds |
| 3,112,856 | A | 12/1963 | MacIntosh et al. |
| 3,157,342 | A | 11/1964 | Grady |
| 3,158,312 | A | 11/1964 | Simkins |
| 3,173,596 | A | 3/1965 | Aust et al. |
| 3,199,763 | A | 8/1965 | Anderson |
| 3,265,283 | A | 8/1966 | Farquhar |
| 3,276,665 | A | 10/1966 | Rasmussen |
| 3,280,968 | A | 10/1966 | Craine |
| 3,348,758 | A | 10/1967 | Ellis |
| 3,434,648 | A | 3/1969 | Du Barry, Jr. |
| 3,653,495 | A | 4/1972 | Gray |
| 3,677,458 | A | 7/1972 | Gosling |
| 3,756,499 | A | 9/1973 | Giebel et al. |
| 3,759,378 | A | 9/1973 | Werth |
| 3,786,914 | A | 1/1974 | Beutler |
| 3,884,348 | A | 5/1975 | Ross |
| 4,005,815 | A | 2/1977 | Nerenberg et al. |
| 4,008,849 | A | 2/1977 | Baber |
| 4,029,207 | A | 6/1977 | Gordon |
| 4,058,250 | A | 11/1977 | Akkerman |
| 4,059,220 | A | 11/1977 | Lorenz |
| 4,101,048 | A | 7/1978 | Rieben et al. |
| 4,101,052 | A | 7/1978 | Dove |
| 4,113,100 | A | 9/1978 | Soja et al. |
| 4,165,031 | A | 8/1979 | Osborne |
| 4,318,474 | A | 3/1982 | Hasegawa |
| 4,498,619 | A | 2/1985 | Roccaforte |
| 4,519,538 | A | 5/1985 | Omichi |
| 4,538,759 | A | 9/1985 | Dutcher |
| 4,558,785 | A | 12/1985 | Gordon |
| 4,586,643 | A | 5/1986 | Halabisky et al. |
| 4,621,766 | A | 11/1986 | McClure |
| 4,679,726 | A | 7/1987 | Oliff |
| 4,742,917 | A | 5/1988 | Bornwasser |
| 4,760,952 | A | 8/1988 | Wachter et al. |
| 4,773,541 | A | 9/1988 | Riddell |
| 4,778,057 | A | 10/1988 | Allen et al. |
| 4,784,316 | A | 11/1988 | Crouch |
| 4,792,084 | A | 12/1988 | Dreeszen |
| 4,815,609 | A | 3/1989 | Kiedaisch |
| 4,836,375 | A | 6/1989 | Schuster et al. |
| 4,865,187 | A | 9/1989 | Zulauf et al. |
| 4,886,160 | A | 12/1989 | Kilgerman |
| 4,901,911 | A | 2/1990 | Drexhage |
| 4,919,269 | A | 4/1990 | Wright et al. |
| 4,966,324 | A | 10/1990 | Steel |
| 4,981,254 | A | 1/1991 | Depper |
| 5,012,929 | A | 5/1991 | Roosa |
| 5,072,876 | A | 12/1991 | Wilson |
| 5,119,985 | A | 6/1992 | Dawson et al. |
| 5,181,650 | A | 1/1993 | Hollander et al. |
| 5,197,598 | A | 3/1993 | Stout et al. |
| 5,222,660 | A | 6/1993 | Koss |
| 5,259,550 | A | 11/1993 | Kuchenbecker |
| 5,328,091 | A | 7/1994 | Koss |
| 5,350,109 | A | 9/1994 | Brown et al. |
| 5,472,136 | A | 12/1995 | Roccaforte |
| 5,560,539 | A | 10/1996 | Baxter |
| 5,588,585 | A | 12/1996 | McClure |
| 5,611,425 | A | 3/1997 | Holley, Jr. |
| 5,699,957 | A | 12/1997 | Blin et al. |
| 5,783,030 | A | 7/1998 | Walsh |
| 5,794,778 | A | 8/1998 | Harris |
| 5,842,576 | A | 12/1998 | Snow |
| 5,857,570 | A | 1/1999 | Brown |
| 5,881,884 | A | 3/1999 | Podosek |
| D412,114 | S | 7/1999 | Hansen |
| 5,921,398 | A | 7/1999 | Carroll |
| 5,927,498 | A | 7/1999 | Saam |
| 5,979,749 | A | 11/1999 | Bozich |
| D419,440 | S | 1/2000 | Hansen |
| 6,015,084 | A | 1/2000 | Mathieu et al. |
| 6,019,276 | A | 2/2000 | Auclair |
| 6,027,017 | A | 2/2000 | Kuhn et al. |
| 6,065,590 | A | 5/2000 | Spivey |
| 6,112,977 | A | 9/2000 | Sutherland et al. |
| 6,129,211 | A | 10/2000 | Prakken et al. |
| 6,131,803 | A | 10/2000 | Oliff et al. |
| 6,135,289 | A | 10/2000 | Miller |
| 6,158,579 | A | 12/2000 | Rosenbaum |
| 6,170,741 | B1 | 1/2001 | Skolik et al. |
| 6,250,542 | B1 | 6/2001 | Negelen |
| 6,273,330 | B1 | 8/2001 | Oliff et al. |
| 6,386,369 | B2 | 5/2002 | Yuhas et al. |
| 6,419,152 | B1 | 7/2002 | Tokarski |
| 6,435,351 | B1 | 8/2002 | Gibb |
| 6,478,159 | B1 | 11/2002 | Taylor et al. |
| 6,510,982 | B2 | 1/2003 | White |
| 6,523,692 | B2 | 2/2003 | Gregory |
| 6,595,411 | B2 | 7/2003 | McClure |
| 6,631,803 | B2 | 10/2003 | Rhodes et al. |
| 6,729,475 | B2 | 5/2004 | Yuhas et al. |
| 6,766,940 | B2 | 7/2004 | Negelen |
| 6,848,573 | B2 | 2/2005 | Gould et al. |
| 6,854,639 | B2 | 2/2005 | Walsh |
| 6,869,009 | B2 | 3/2005 | Sutherland et al. |
| 6,905,027 | B2 | 6/2005 | Galter |
| 6,913,189 | B2 | 7/2005 | Oliff et al. |
| 6,918,487 | B2 | 7/2005 | Harrelson |
| 6,968,992 | B2 | 11/2005 | Schuster |
| 7,021,468 | B2 | 4/2006 | Cargile, Jr. |
| 7,201,714 | B2 | 4/2007 | Zoeckler et al. |
| 7,234,596 | B2 | 6/2007 | Lebras |
| 7,337,909 | B1 | 4/2008 | Morgan |
| 7,614,497 | B2 | 11/2009 | Spivey, Sr. |
| 7,703,666 | B2 | 4/2010 | Hand et al. |
| 7,743,970 | B2 | 6/2010 | Bates et al. |
| 7,748,603 | B2 | 7/2010 | Fogle et al. |
| 7,757,933 | B2 | 7/2010 | Dunn |
| 7,775,418 | B2 | 8/2010 | Walling |
| 7,780,003 | B2 | 8/2010 | Harrelson |
| 7,780,067 | B2 | 8/2010 | Holley, Jr. |
| 7,806,314 | B2 | 10/2010 | Sutherland |
| 7,815,097 | B2 | 10/2010 | Fogle et al. |
| 7,832,622 | B2 | 11/2010 | Spivey, Sr. |
| 7,900,816 | B2 | 3/2011 | Kastanek et al. |

(56) References Cited

U.S. PATENT DOCUMENTS

| | | | |
|---|---|---|---|
| 7,959,062 | B2 | 6/2011 | Auclair |
| 7,984,843 | B2 | 7/2011 | Cooper et al. |
| 7,998,047 | B2 | 8/2011 | Spivey, Sr. et al. |
| 8,070,052 | B2 | 12/2011 | Spivey, Sr. et al. |
| 8,191,761 | B2 | 6/2012 | Brand |
| 8,216,118 | B2 | 7/2012 | Dunn |
| 8,231,513 | B2 | 7/2012 | Smalley |
| 8,302,811 | B2 | 11/2012 | Spivey |
| 8,453,918 | B2 | 6/2013 | Hsiao et al. |
| 8,584,926 | B2 | 11/2013 | Bull |
| 8,602,292 | B2 | 12/2013 | Brand |
| 8,622,280 | B2 | 1/2014 | Coltri-Johnson et al. |
| 8,783,550 | B2 | 7/2014 | Schuster |
| 8,827,144 | B2 | 9/2014 | Gomes et al. |
| 8,967,380 | B2 | 3/2015 | Moncrief et al. |
| 9,033,210 | B2 | 5/2015 | Kastanek |
| 9,073,680 | B2 | 7/2015 | Kastanek |
| 2001/0048022 | A1 | 12/2001 | Zoeckler |
| 2002/0170845 | A1 | 11/2002 | Oliff |
| 2003/0226879 | A1 | 12/2003 | Auclair et al. |
| 2005/0087592 | A1 | 4/2005 | Schuster |
| 2005/0092649 | A1 | 5/2005 | Ford et al. |
| 2005/0167291 | A1 | 8/2005 | Sutherland |
| 2005/0167292 | A1 | 8/2005 | Sutherland |
| 2005/0189405 | A1 | 9/2005 | Gomes et al. |
| 2005/0218203 | A1 | 10/2005 | Harrelson |
| 2005/0263574 | A1 | 12/2005 | Schuster |
| 2006/0081691 | A1 | 4/2006 | Smalley |
| 2006/0169755 | A1 | 8/2006 | Spivey, Sr. |
| 2006/0261138 | A1 | 11/2006 | Bates et al. |
| 2006/0266815 | A1 | 11/2006 | Coltri-Johnson et al. |
| 2006/0278689 | A1 | 12/2006 | Boshinski et al. |
| 2006/0278691 | A1 | 12/2006 | Bezek |
| 2007/0063003 | A1 | 3/2007 | Spivey et al. |
| 2007/0108261 | A1 | 5/2007 | Schuster |
| 2007/0131748 | A1 | 6/2007 | Brand |
| 2008/0110967 | A1 | 5/2008 | Walling |
| 2008/0203143 | A1 | 8/2008 | Holley |
| 2008/0265008 | A1 | 10/2008 | Holley |
| 2009/0095799 | A1 | 4/2009 | Garner |
| 2010/0025457 | A1 | 2/2010 | Cooper et al. |
| 2010/0163609 | A1 | 7/2010 | Bull |
| 2011/0240725 | A1 | 10/2011 | Spivey et al. |
| 2011/0240727 | A1 | 10/2011 | Cameron |
| 2011/0284624 | A1 | 11/2011 | DeBusk et al. |
| 2012/0012600 | A1 | 1/2012 | Gonzalez |
| 2012/0067755 | A1 | 3/2012 | Spivey, Sr. |
| 2012/0091021 | A1 | 4/2012 | Smalley |
| 2012/0152768 | A1 | 6/2012 | Cheema et al. |

FOREIGN PATENT DOCUMENTS

| | | |
|---|---|---|
| DE | 298 17 195 | 11/1998 |
| DE | 202 16 854 | 1/2003 |
| EP | 0 133 595 | 2/1985 |
| EP | 0 704 386 | 4/1996 |
| EP | 0 870 688 | 10/1998 |
| EP | 1 852 359 | 11/2007 |
| FR | 1.379.931 | 12/1963 |
| FR | 2 663 001 A1 | 12/1991 |
| FR | 2 882 032 | 8/2006 |
| GB | 1 218 016 | 1/1971 |
| JP | 11-301649 | 11/1999 |
| JP | 2000-006956 | 1/2000 |
| WO | WO 98/31593 | 7/1998 |
| WO | WO 99/28198 | 6/1999 |
| WO | WO 03/082686 | 10/2003 |
| WO | WO 2004/063031 | 7/2004 |
| WO | WO 2008/027954 | 3/2008 |

OTHER PUBLICATIONS

International Search Report and Written Opinion for PCT/US2015/060572 dated Feb. 19, 2016.

International Search Report and Written Opinion for PCT/US2015/060566 dated Feb. 22, 2016.

CARTON WITH REINFORCEMENT FEATURES

CROSS-REFERENCE TO RELATED APPLICATION

This application claims the benefit of U.S. Provisional Patent Application No. 62/123,438, filed Nov. 17, 2014.

INCORPORATION BY REFERENCE

The disclosure of U.S. Provisional Patent Application No. 62/123,438, which was filed on Nov. 17, 2014, is hereby incorporated by reference for all purposes as if presented herein in its entirely.

BACKGROUND OF THE DISCLOSURE

The present disclosure generally relates to cartons or carriers for holding beverage containers or other types of articles. More specifically, the present disclosure relates to cartons that include reinforcement features for strengthening the carton.

SUMMARY OF THE DISCLOSURE

In general, one aspect of the disclosure is directed to a carton for carrying a plurality of articles. The carton comprises at least one top panel, a first side panel, a second side panel, and a bottom panel. A plurality of end flaps is foldably connected to a respective panel to close an end of the carton. The carton includes reinforcement features at the end of the carton to increase the strength of the carton.

In another aspect, the present disclosure is generally directed to a carton for carrying a plurality of articles. The carton comprising a plurality of panels that extend at least partially around an interior of the carton. The plurality of panels comprising at least one top panel, a first side panel, a second side panel, and bottom panel. A plurality of end flaps are each foldably connected to a respective panel of the plurality of panels for closing an end of the carton. At least one end flap of the plurality of end flaps has reinforcement features for increasing the strength of the carton. The reinforcement features comprising a base portion foldably connected to the first side panel, an intermediate portion foldably connected to the base portion, and a distal portion foldably connected to the intermediate portion.

In another aspect, the present disclosure is generally directed to a blank for forming a carton for carrying a plurality of articles. The blank comprising a plurality of panels comprising at least one top panel, a first side panel, a second side panel, and bottom panel. A plurality of end flaps are each foldably connected to a respective panel of the plurality of panels for closing an end of the carton formed from the blank. At least one end flap of the plurality of end flaps has reinforcement features for increasing the strength of the carton formed from the blank. The reinforcement features comprising a base portion foldably connected to the first side panel, an intermediate portion foldably connected to the base portion, and a distal portion foldably connected to the intermediate portion.

In another aspect, the present disclosure is generally directed to a method of forming a carton for carrying a plurality of articles. The method comprising obtaining a blank comprising a plurality of panels comprising at least one top panel, a first side panel, a second side panel, and a bottom panel. A plurality of end flaps are each foldably connected to a respective panel of the plurality of panels, wherein at least one end flap of the plurality of end flaps has reinforcement features for increasing the strength of the carton. The reinforcement features comprising a base portion foldably connected to the first side panel, an intermediate portion foldably connected to the base portion, and a distal portion foldably connected to the intermediate portion. The method comprises positioning the plurality of panels to form an interior of the carton, closing an end of the carton by at least partially overlapping the plurality of end flaps, and positioning the reinforcement features to increase the strength of the carton. The positioning the reinforcement features comprising positioning the base portion, intermediate portion, and distal portion to increase the strength of the carton.

Other aspects, features, and details of the present disclosure can be more completely understood by reference to the following detailed description of exemplary embodiments taken in conjunction with the drawings and from the appended claims.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons that contain articles such as containers, pouches, bottles, cans, boxes, etc. The articles can be used for packaging food and beverage products, for example. The articles can be made from materials suitable in composition for packaging the particular food or beverage item, and the materials include, but are not limited to, flexible pouch material such as laminates including aluminum and synthetic polymer layers; flexible pouch material such as laminates including synthetic polymer layers; aluminum and/or other metals; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes flexible pouches (e.g., juice pouches) as disposed within the carton embodiments. In this specification, the terms "lower," "bottom," "upper" and "top" indicate orientations determined in relation to fully erected and upright cartons.

Figure 1:
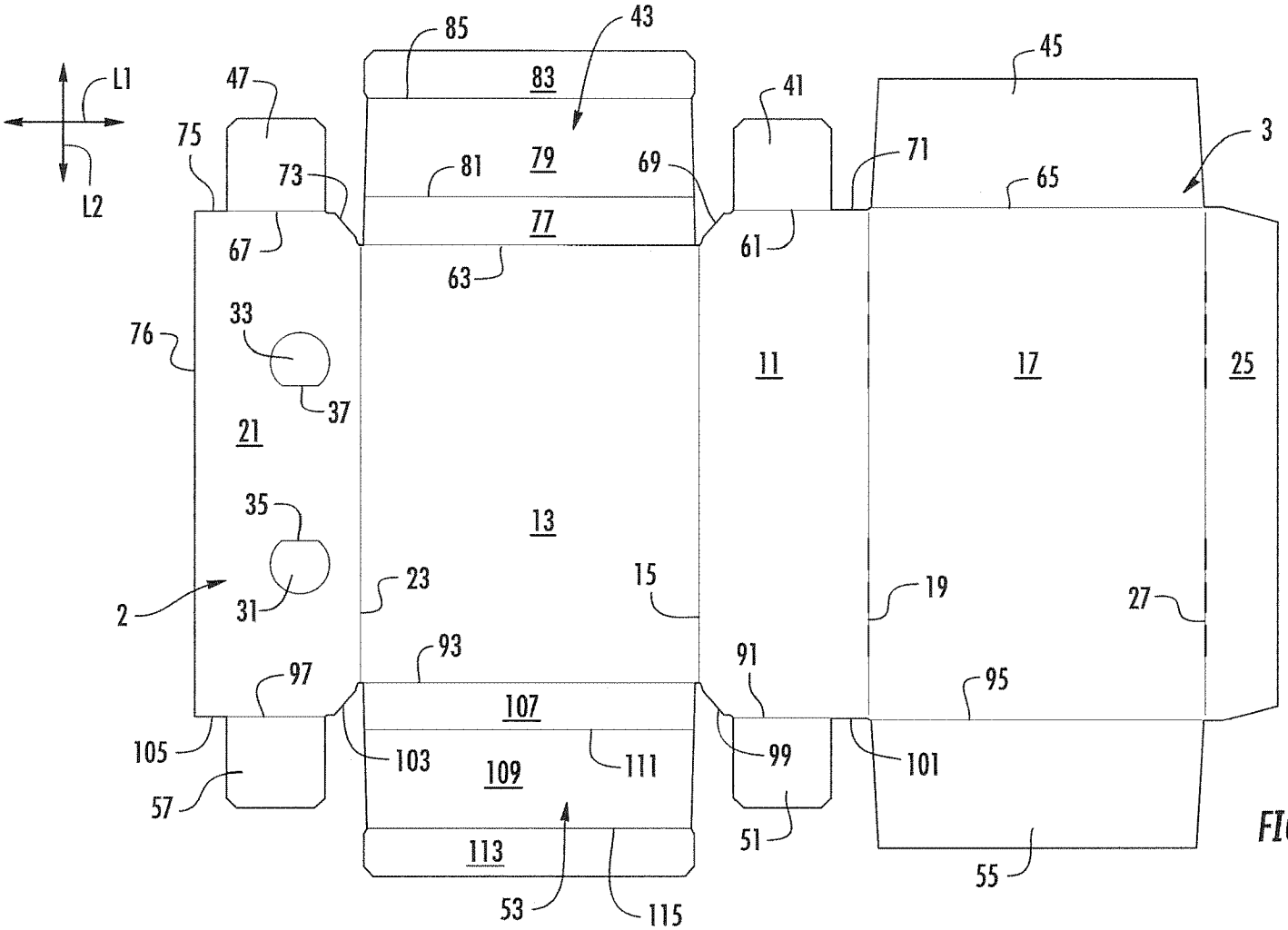
FIG. 1 is an exterior plan view of a carton blank used to form a carton in accordance with an embodiment of the disclosure.
Figure 5:
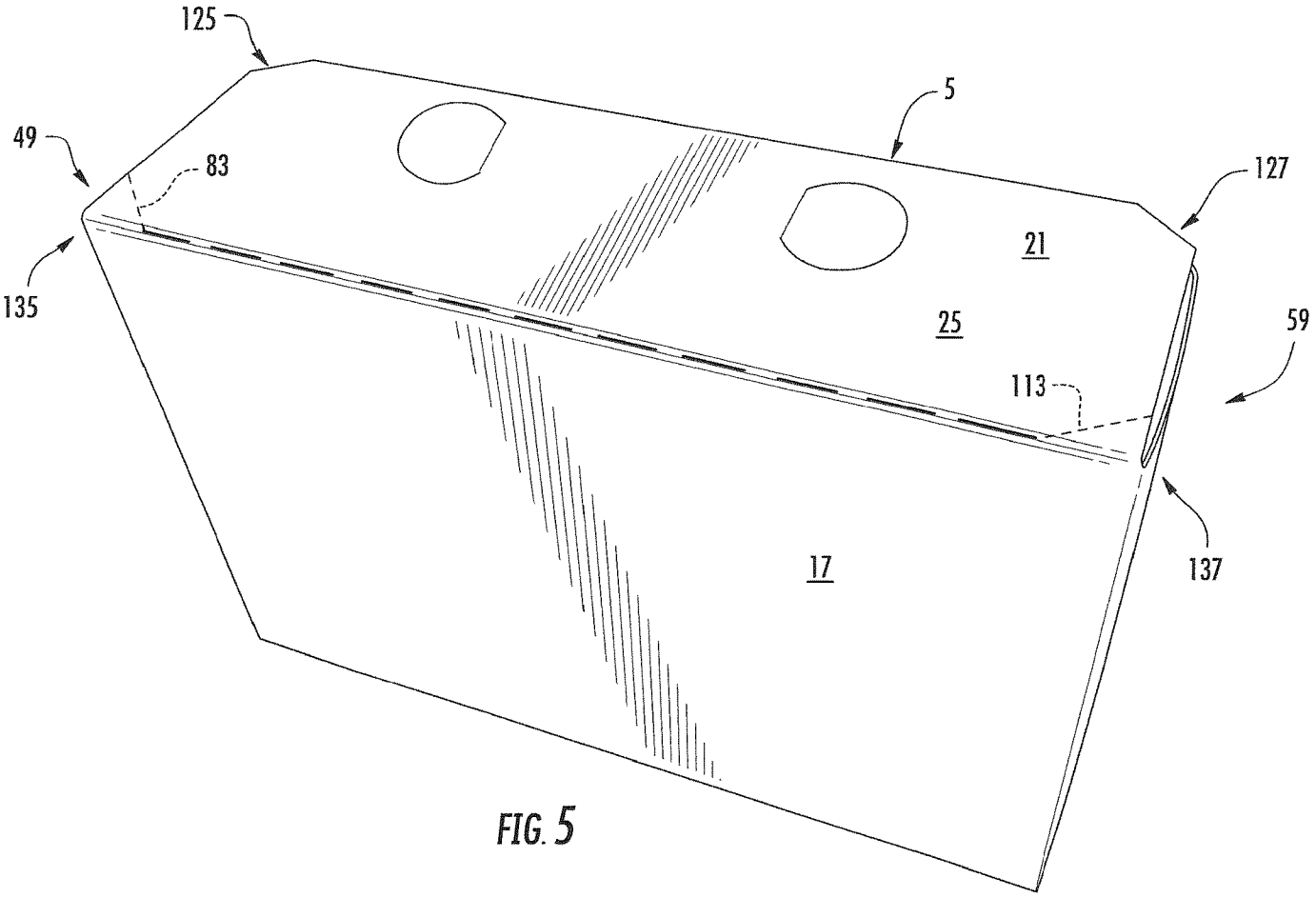
FIG. 5 is a perspective view of the assembled carton in accordance with the embodiment of this disclosure.
Figure 6:
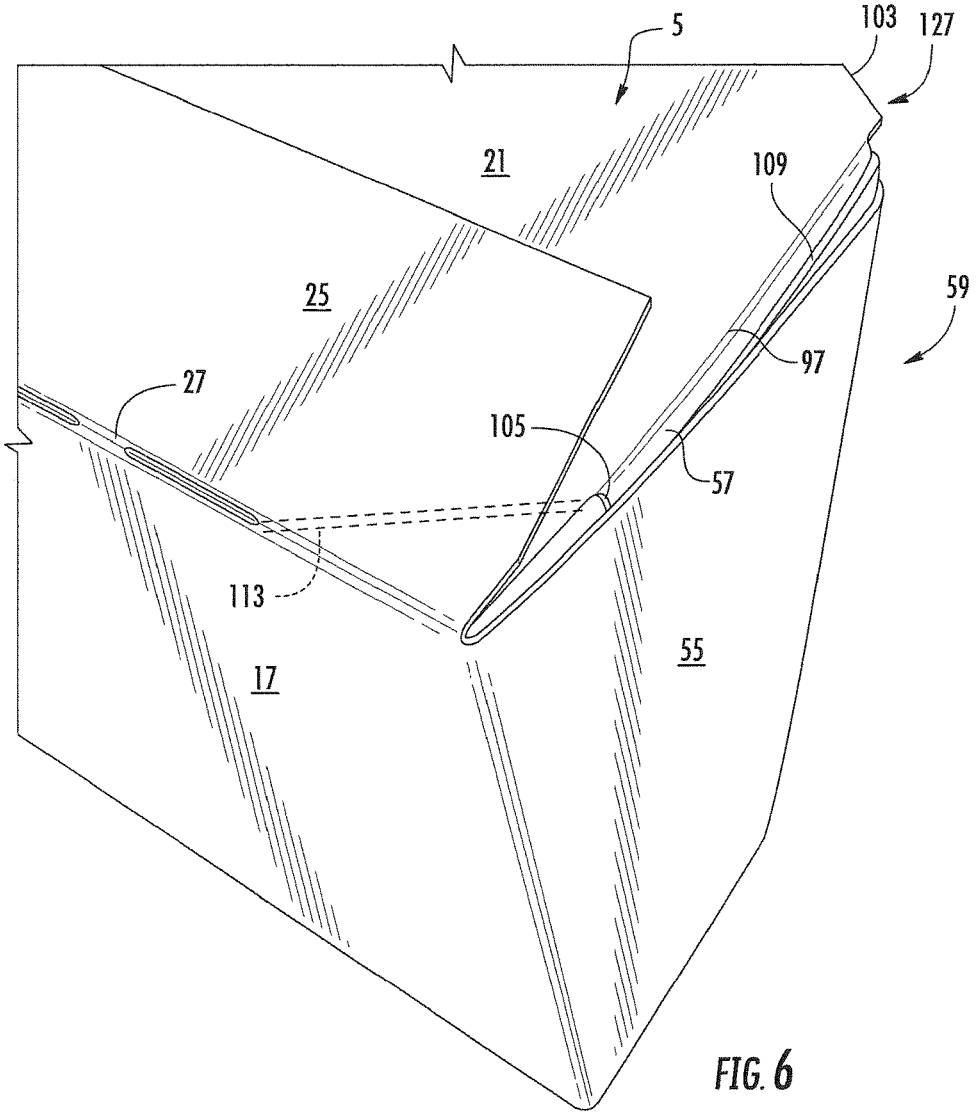
FIG. 6 is a close-up view of a corner of the assembled carton in accordance with the embodiment of this disclosure.

FIG. 1 is a plan view of an exterior surface 2 of a blank 3, used to form a carton 5, shown in FIGS. 5-6, according to one embodiment of the disclosure. The carton 5 can be used to house a plurality of articles such as containers C (e.g., see exemplary containers C shown in FIG. 3). In one embodiment, the containers C can be flexible pouches commonly referred to as juice pouches, although the containers can contain fluids other than juice. The containers C can be any suitable beverage container such as any shape, size, and type of containers or any other container containing products such as beverages or products other than beverages without departing from the disclosure.

In one embodiment, the blank 3 is sized to form a carton 5 that contains ten containers C in two layers with each layer having five containers (e.g., a 2×5 arrangement). But, it is understood that the blank 3 and/or carton 5 may be sized and shaped to hold containers C of a different or same quantity in a single layer or more than two layers and/or in different row/column arrangements (e.g., 1×6, 2×3, 2×4, 2×6, 2×4, 2×2, 2×6×2, 2×4×2, 2×9, etc.). In the illustrated embodiment, the carton 5 has reinforcement features for strengthening the carton to allow stacking of multiple cartons without failure (e.g., crushing) of the carton.

As shown in FIG. 1, the blank 3 has a longitudinal axis L1 and a lateral axis L2. In the illustrated embodiment, the blank 3 comprises a bottom panel 11 foldably connected to a first side panel 13 at a lateral fold line 15, a second side panel 17 foldably connected to the bottom panel at a lateral fold line 19, a first top panel 21 foldably connected to the first side panel 13 at a lateral fold line 23, and a second top panel 25 foldably connected to the second side panel 17 at a lateral fold line 27. In one embodiment, the first top panel 21 includes handle flaps 31, 33 respectively foldably connected to the first top panel at longitudinal fold lines 35, 37. The handle flaps 31, 33 could be otherwise shaped, arranged, configured, and/or omitted without departing from the disclosure.

In one embodiment, the panels 11, 13, 17, 21 have respective first end flaps 41, 43, 45, 47, at a first marginal portion of the blank 3 such that the first end flaps are foldably connected to respective panels to close a first end 49 of the carton 5. The panels 11, 13, 17, 21 have respective second end flaps 51, 53, 55, 57 at a second marginal portion of the blank 3 such that the second end flaps are foldably connected to respective panels to close a second end 59 of the carton. As shown in FIG. 1, the bottom end flap 41 is foldably connected to the bottom panel 11 at a longitudinal fold line 61, the side end flap 43 is foldably connected to the first side panel 13 at a longitudinal fold line 63, the side end flap 45 is foldably connected to the second side panel 17 at a longitudinal fold line 65, and the top end flap 47 is foldably connected to the first top panel 21 at a longitudinal fold line 67. In one embodiment, the bottom panel 11 includes an oblique edge 69 between the fold lines 61, 63 and a straight edge 71 between the fold lines 61, 65. Similarly, the first top panel 21 includes an oblique edge 73 between the fold lines 63, 67 and a straight edge between the fold line 67 and the lateral edge 76 of the blank 3. As shown in FIG. 1, the side end flap 43 includes a base portion 77 foldably connected to the first side panel 13 at fold line 63, an intermediate portion 79 foldably connected to the base portion at a longitudinal fold line 81, and a distal portion 83 foldably connected to the intermediate portion at a longitudinal fold line 85. In the illustrated embodiment, the second top panel 25 is free from first or second end flaps, but the second top panel could be otherwise shaped, arranged, and/or configured without departing from the disclosure.

As shown in FIG. 1, the second marginal portion of the blank 3 is a mirror image of the first marginal portion so that the second end flaps 51, 53, 55, 57 are shaped to have identical features as the first end flaps 41, 43, 45, 47. As such, the second end flaps 51, 53, 55, 57 are foldably connected to a respective panel 11, 13, 17, 21 at a respective fold line 91, 93, 95, 97. The bottom panel 11 has an oblique edge 99 and straight edge 101 at the second marginal portion of the blank 3, and the first top panel 21 has an oblique edge 103 and a straight edge 105 at the second marginal portion of the blank. The side end flap 53 at the second marginal portion of the blank 3 has a base portion 107 foldably connected to the first side panel 13 at the longitudinal fold line 93, a intermediate portion 109 foldably connected to the base portion at a longitudinal fold line 111, and a distal portion 113 foldably connected to the intermediate portion 109 at a longitudinal fold line 115. The first end flaps 41, 43, 45, 47 and the second end flaps 51, 53, 55, 57 could be otherwise shaped, arranged, and/or configured without departing from the disclosure.

Figure 2:
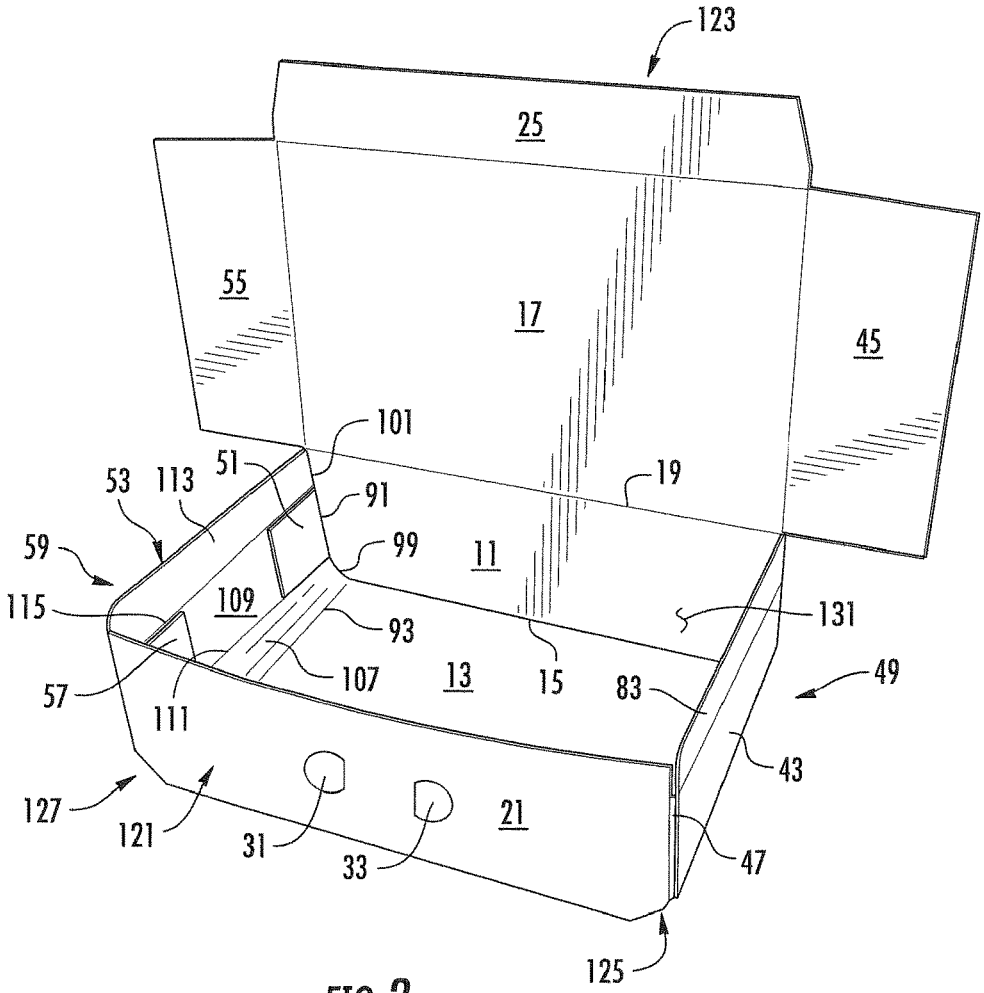
FIG. 2 is a perspective view of the carton in a partly assembled configuration in accordance with the embodiment of the disclosure.

FIGS. 2-6 show one exemplary method of forming the blank 3 into the carton 5. In one embodiment, the first top panel 21, the bottom panel 11, and the side end flaps 43, 53 are upwardly folded relative to the first side panel 13 at respective fold lines 15, 23, 63, 93 to form a tray 121. The end flaps 41, 51 connected to the bottom panel 11 are inwardly folded at respective fold lines 61, 91 and positioned to be in face-to-face contact and adhered to a respective side end flap 43, 53. As shown in FIG. 2, the base portions 77, 107 of respective side end flaps 43, 53 is angled or positioned to be oblique relative to the first side panel 13, with the intermediate portions 79, 109 and distal portions 83, 113, positioned to be generally perpendicular to the first side panel 13. As shown in FIG. 2, the end flaps 51, 57 are adhered in face-to-face contact with the intermediate portion 109 of the end flap 53 and the end flaps 41, 47 are adhered in face-to-face contact with the intermediate portion 79 of the end flap 43. The oblique base portions 77, 107 of the end flaps 43, 53 conform to respective oblique edges 69, 73, 99, 103 of the bottom panel 11 and the first top panel 21 to form respective angled corners 125, 127 at the ends 49, 59 of the carton 5. In one embodiment, the second side panel 17, the second top panel 25, and the end flaps 45, 55 form a lid 123 that is foldably connected to the tray 121 at the fold line 19.

Figure 3:
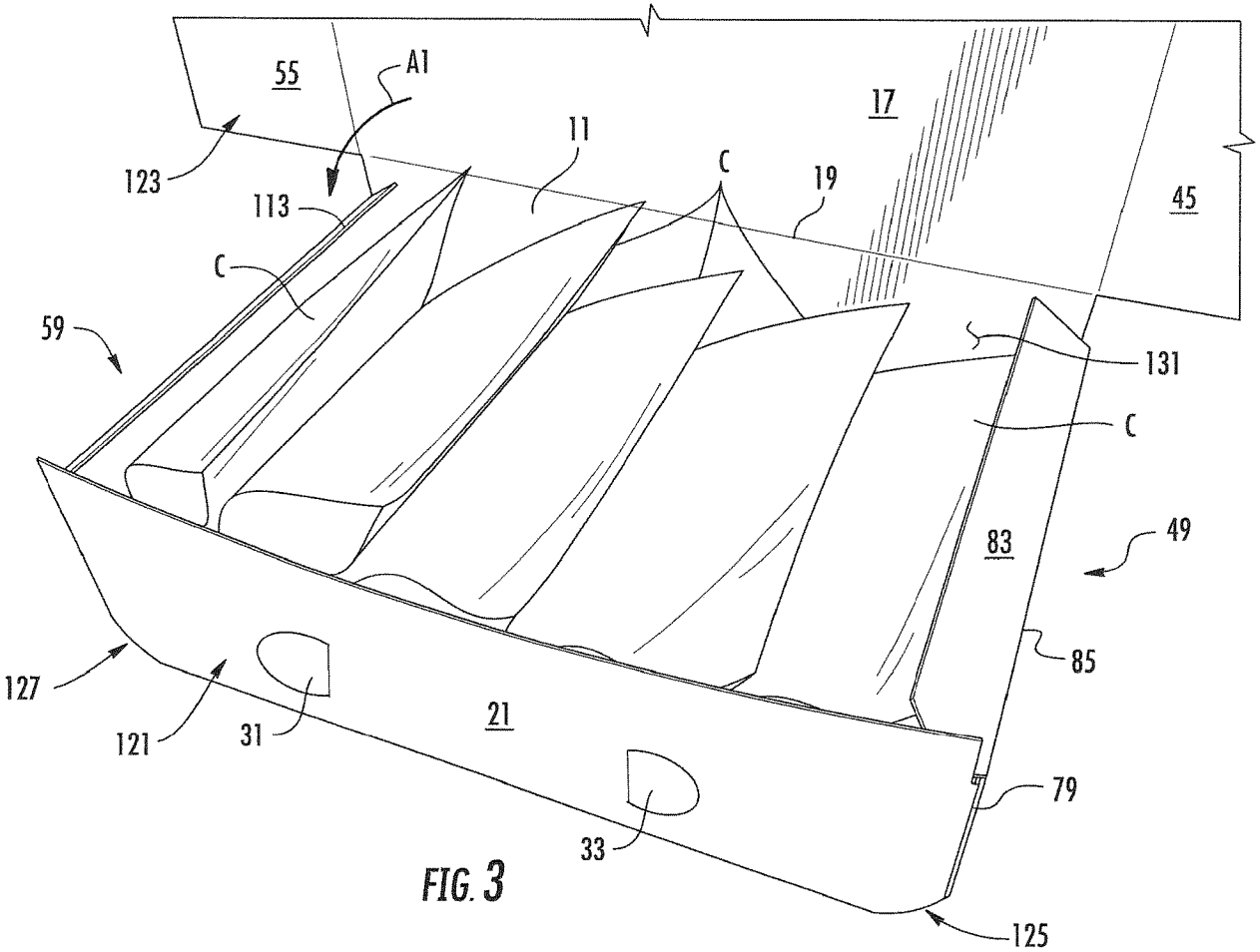
FIG. 3 is a perspective view of the carton in a further assembled configuration with articles placed in the interior of the carton in accordance with the embodiment of the disclosure.
Figure 4:
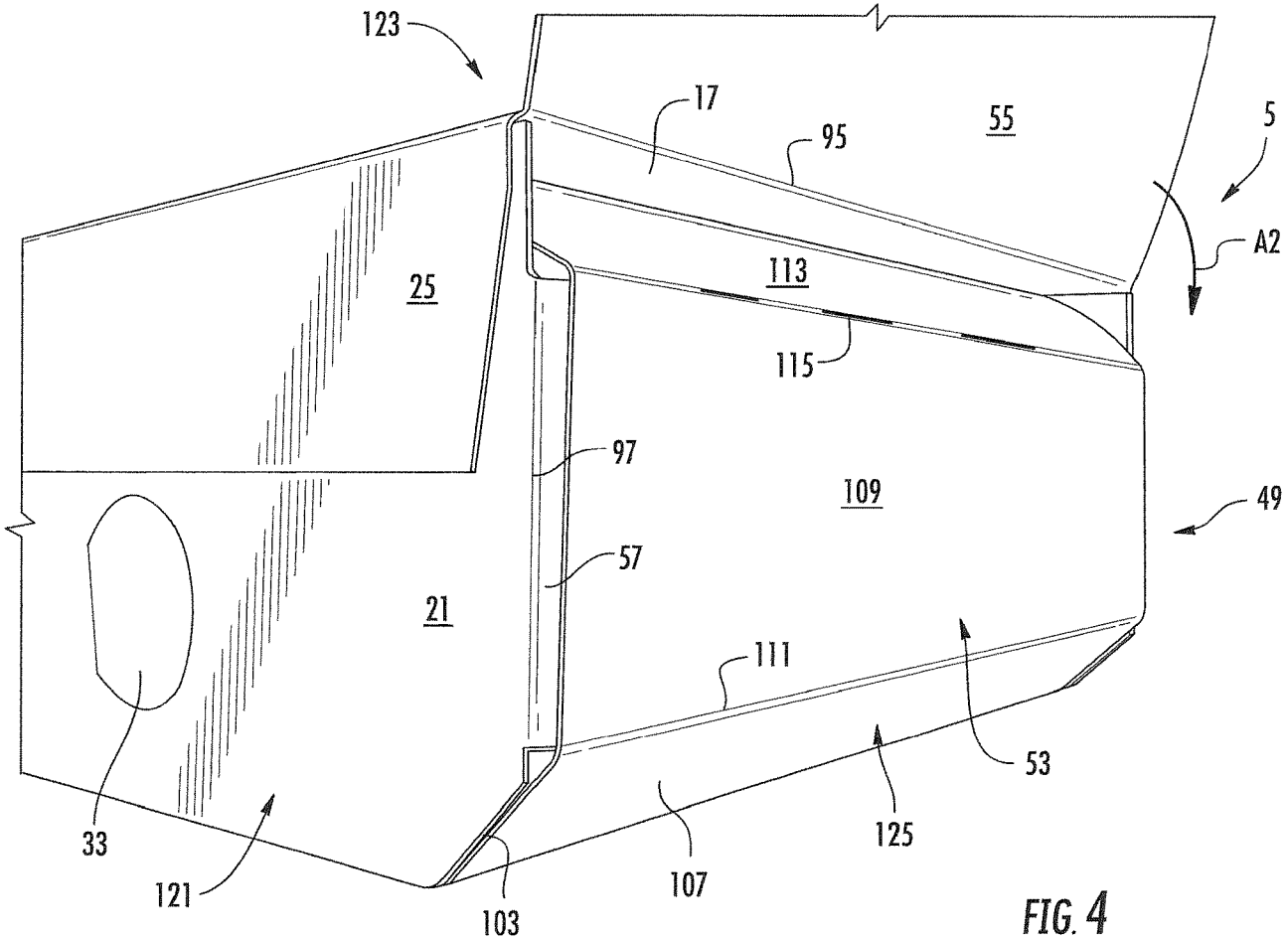
FIG. 4 is a close-up view of an end of the carton having reinforcement features in accordance with the embodiment of the disclosure.

As shown in FIG. 3, the containers C are loaded in the interior space 131 of the tray 121. In one embodiment, eight containers C are placed in the interior space 131 arranged in two layers of four containers, but other quantities and arrangements of containers can be loaded in the carton 5 without departing from the disclosure. Further, the containers C can be loaded by other methods or steps. After the containers C are loaded in the tray 121, the distal portions 83, 113 of the side end flaps 43, 53 are downwardly folded relative to the intermediate portions 79, 109. As shown in FIG. 4, the lid 123 is downwardly folded relative to the tray 121 at fold line 19 (and in the direction of arrow A1 in FIG. 3) so that the second side panel 17 closes the interior space 131 of the tray. In one embodiment, the edge of the distal portions 83, 113 engages the second side panel to keep the distal portions at an oblique angle relative to the intermediate portions 79, 109 of the end flaps 43, 53. The end flaps 43, 53 are sized so that the distal portions 83, 113 of the end flaps extend far enough into the interior space 131 to be engaged by the second side panel 17 when the lid 123 is downwardly folded so that the distal portions 83, 113 are secured in the oblique position relative to the intermediate portions 79, 109. As shown in FIGS. 6 and 7, the end flaps 45, 55 are downwardly folded in the direction of arrow A2 (FIG. 4) to overlap the end flaps 43, 43 and close the ends 49, 59 and the second side panel 25 is downwardly folded to overlap the first side panel 21. The end flaps 45, 55 of the lid 123 can be adhesively attached to the intermediate portions 79, 109 of the end flaps 43, 53 by an adhesive such as glue. The second top panel 25 can be secured to the first top panel 21 by glue. The carton 5 could be formed by other steps or forming methods without departing from the disclosure.

In one embodiment, the downwardly folded end flaps 45, 55 form an external corner 135, 137 at a respective end 49, 59 that is square or orthogonal (i.e., the end flaps 45, 55 are positioned at 90 degrees relative to the second side panel 17). Each of the corners 135, 137 includes a respective angle distal portion 83, 113 of the end flaps 43 that is oblique relative to the end flaps 45, 55 that are in face-to-face contact with the intermediate portion 79, 109 of a respective end flap 43, 53. In this way, the corners 135, 137 include internal oblique reinforcement portions in the form of the distal portions 83, 113 that are not visible from the exterior of the carton. The oblique distal portions 83, 113 are the reinforcement features of the carton 5 that provide an internal structural member that increases the strength of the carton and increases the resistance to crushing of the carton when the cartons are stacked on top of each other. Because of the increased strength resulting from the internal structural members 83, 113, the carton 5 and blank 3 can be manufactured from lighter or thinner material thus saving manufacturing costs. In one embodiment that the oblique distal portions 83, 113 and the oblique base portions 77, 107 of the end flaps 43, 53 cooperate to form the reinforcement features at the ends 49, 59 of the carton 5. The carton 5 could have other features without departing from the scope of the disclosure.

In general, the blanks described herein may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding thereal-long. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for carrying a plurality of articles, the carton comprising:

a plurality of panels that extend at least partially around an interior of the carton, the plurality of panels comprising at least one top panel, a first side panel, a second side panel, and bottom panel;

a plurality of end flaps each foldably connected to a respective panel of the plurality of panels for closing an end of the carton, wherein at least one end flap of the plurality of end flaps has reinforcement features for increasing the strength of the carton, the reinforcement features comprising a base portion foldably connected to the first side panel, an intermediate portion foldably connected to the base portion, and a distal portion foldably connected to the intermediate portion, the distal portion extending from the intermediate portion to a free edge of the distal portion;

wherein each of the base portion and the distal portion is positioned at an oblique angle relative to the intermediate portion, and the distal portion extends from the intermediate portion toward the second side panel.

2. The carton of claim 1, wherein the free edge of the distal portion is in contact with the second side panel.

3. The carton of claim 1, wherein the at least one end flap is a first side end flap foldably connected to the first side panel, the plurality of end flaps comprises a top end flap foldably connected to the at least one top panel, and the intermediate portion is in face-to-face contact with the top end flap.

4. The carton of claim 3, wherein the plurality of end flaps comprises a bottom end flap foldably connected to the bottom panel, and the intermediate portion is in face-to-face contact with the bottom end flap.

5. The carton of claim 4, wherein the at least one top panel comprises a first oblique edge, the bottom panel comprises a second oblique edge, and the base portion of the first side end flap conforms to the first oblique edge and second oblique edge to form a corner of the carton.

6. The carton of claim 1, wherein the at least one end flap is a first side end flap foldably connected to the first side panel, and the plurality of end flaps comprises a second side end flap foldably connected to the second side panel, and wherein the second side end flap is in face-to-face contact with the intermediate portion of the first side end flap.

7. The carton of claim 6, wherein the second side end flap forms an external corner of the carton, the external corner being spaced apart from the distal portion of the first side end flap, and wherein the first side end flap is internal to the second side end flap.

8. The carton of claim 1, wherein the plurality of end flaps is a first plurality of end flaps at a first end of the carton, the carton further comprises a second plurality of end flaps at a second end of the carton, the reinforcement features are first reinforcement features, and the carton comprises second reinforcement features in at least one end flap of the second plurality of end flaps.

9. The carton of claim 8, wherein the second reinforcement features of the at least one end flap of the second plurality of end flaps comprises a base portion foldably connected to the first side panel, an intermediate portion foldably connected to the base portion, and a distal portion foldably connected to the intermediate portion.

10. The carton of claim 1, further comprising a handle, the handle comprising at least one handle flap foldably connected to the at least one top panel.

11. The carton of claim 1, wherein the free edge is a first free edge, the distal portion comprises a second free edge and a third free edge extending from respective ends of the first free edge, and the second free edge contacts an inner face of the top panel, and the third free edge contacts an inner face of the bottom panel.

12. A blank for forming a carton for carrying a plurality of articles, the blank comprising:

a plurality of panels comprising at least one top panel, a first side panel, a second side panel, and bottom panel;

a plurality of end flaps each foldably connected to a respective panel of the plurality of panels for closing an end of the carton formed from the blank, at least one end flap of the plurality of end flaps has reinforcement features for increasing the strength of the carton formed from the blank, the reinforcement features comprising a base portion foldably connected to the first side panel, an intermediate portion foldably connected to the base portion, and a distal portion foldably connected to the intermediate portion, the distal portion extending from the intermediate portion to a free edge of the distal portion;

wherein each of the base portion and the distal portion is positioned at an oblique angle relative to the intermediate portion when the carton is formed from the blank, and the distal portion extends from the intermediate portion toward the second side panel when the carton is formed from the blank.

13. The blank of claim 12, wherein the free edge of the distal portion is in contact with the second side panel when the carton is formed from the blank.

14. The blank of claim 12, wherein the at least one end flap is a first side end flap foldably connected to the first side panel, the plurality of end flaps comprises a top end flap foldably connected to the at least one top panel, and the intermediate portion is in face-to-face contact with the top end flap when the carton is formed from the blank.

15. The blank of claim 14, wherein the plurality of end flaps comprises a bottom end flap foldably connected to the bottom panel, and the intermediate portion is in face-to-face contact with the bottom end flap when the carton is formed from the blank.

16. The blank of claim 15, wherein the at least one top panel comprises a first oblique edge, the bottom panel comprises a second oblique edge, and the base portion of the first side end flap conforms to the first oblique edge and second oblique edge to form a corner of the carton when the carton is formed from the blank.

17. The blank of claim 12, wherein the at least one end flap is a first side end flap foldably connected to the first side panel, the plurality of end flaps comprises a second side end flap foldably connected to the second side panel, and the second side end flap is in face-to-face contact with the intermediate portion of the first side end flap when the carton is formed from the blank.

18. The blank of claim 17, wherein the second side end flap forms an external corner of the carton when the carton is formed from the blank, the external corner is spaced apart from the distal portion of the first side end flap when the carton is formed from the blank, and the first side end flap is internal to the second side end flap when the carton is formed from the blank.

19. The blank of claim 12, wherein the plurality of end flaps is a first plurality of end flaps at a first end of the blank, the blank further comprises a second plurality of end flaps at a second end of the blank, the reinforcement features are first reinforcement features, and the blank further comprises second reinforcement features in at least one end flap of the second plurality of end flaps.

20. The blank of claim 19, wherein the second reinforcement features of the at least one end flap of the second plurality of end flaps comprises a base portion foldably connected to the first side panel, an intermediate portion foldably connected to the base portion, and a distal portion foldably connected to the intermediate portion.

21. The blank of claim 12, further comprising a handle, the handle comprising at least one handle flap foldably connected to the at least one top panel.

22. The blank of claim 12, wherein the free edge is a first free edge, the distal portion comprises a second free edge and a third free edge extending from respective ends of the first free edge, and the second free edge contacts an inner face of the top panel when the carton is formed from the blank, and the third free edge contacts an inner face of the bottom panel when the carton is formed from the blank.

23. A method of forming a carton for carrying a plurality of articles, the method comprising:

obtaining a blank comprising a plurality of panels comprising at least one top panel, a first side panel, a second side panel, and bottom panel, a plurality of end flaps each foldably connected to a respective panel of the plurality of panels, wherein at least one end flap of the plurality of end flaps has reinforcement features for increasing the strength of the carton, the reinforcement features comprising a base portion foldably connected to the first side panel, an intermediate portion foldably connected to the base portion, and a distal portion foldably connected to the intermediate portion, the distal portion extending from the intermediate portion to a free edge of the distal portion;

positioning the plurality of panels to form an interior of the carton;

closing an end of the carton by at least partially overlapping the plurality of end flaps; and positioning the reinforcement features to increase the strength of the carton, the positioning the reinforcement features comprising positioning the base portion, intermediate portion, and distal portion to increase the strength of the carton, wherein positioning the base portion comprises positioning the base portion at an oblique angle relative to the intermediate portion, positioning the distal portion comprises positioning the distal portion at an oblique angle relative to the intermediate portion and positioning the distal portion to extend from the intermediate portion toward the second side panel.

24. The method of claim 23, wherein positioning the distal portion comprises positioning the free edge to be in contact with the second side panel.

25. The method of claim 23, wherein the at least one end flap is a first side end flap foldably connected to the first side panel, the plurality of end flaps comprises a top end flap foldably connected to the at least one top panel, and positioning the intermediate portion comprises positioning the intermediate portion to be in face-to-face contact with the top end flap.

26. The method of claim 25, wherein the plurality of end flaps comprises a bottom end flap foldably connected to the bottom panel and positioning the intermediate portion comprises positioning the intermediate portion to be in face-to-face contact with the bottom end flap.

27. The method of claim 26, wherein the at least one top panel comprises a first oblique edge, the bottom panel comprises a second oblique edge, and the positioning the plurality of panels comprises conforming the base portion of the first side end flap to the first oblique edge and second oblique edge to form a corner of the carton.

28. The method of claim 23, wherein the at least one end flap is a first side end flap foldably connected to the first side panel, the plurality of end flaps comprises a second side end flap foldably connected to the second side panel, and the positioning the intermediate portion comprises positioning the intermediate portion to be in face-to-face contact with the second side end flap.

29. The method of claim 28, wherein positioning the plurality of panels comprises positioning the first side end flap internal to the second side end flap, positioning the second side end flap to form an external corner of the carton, and positioning the distal portion to be spaced apart from the external corner.

30. The method of claim 23, wherein the plurality of end flaps is a first plurality of end flaps at a first end of the blank, the reinforcement features are first reinforcement features, the blank further comprises a second plurality of end flaps at a second end of the blank and second reinforcement features in at least one end flap of the second plurality of end flaps, and wherein the method further comprises closing a first end of the carton by at least partially overlapping the first plurality of end flaps, closing a second end of the carton by at least partially overlapping the second plurality of end flaps, and positioning the first reinforcement features and the second reinforcement features to increase the strength of the carton.

31. The method of claim 30, wherein the second reinforcement features of the at least one end flap of the second plurality of end flaps comprises a base portion foldably connected to the first side panel, an intermediate portion foldably connected to the base portion, and a distal portion foldably connected to the intermediate portion, and wherein the positioning the reinforcement features comprises positioning the base portions, intermediate portions, and distal portions to increase the strength of the carton.

32. The method of claim 23, wherein the carton further comprises a handle, the handle comprising at least one handle flap foldably connected to the at least one top panel, and wherein the method further comprises forming the handle from the at least one handle flap.

* * * * *